US007552880B2

(12) United States Patent
Dallmeyer

(10) Patent No.: US 7,552,880 B2
(45) Date of Patent: Jun. 30, 2009

(54) FUEL INJECTOR WITH A DEEP-DRAWN THIN SHELL CONNECTOR MEMBER AND METHOD OF CONNECTING COMPONENTS

(75) Inventor: Michael Dallmeyer, Newport News, VA (US)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 29 days.

(21) Appl. No.: 11/195,056

(22) Filed: Aug. 2, 2005

(65) Prior Publication Data

US 2006/0060680 A1 Mar. 23, 2006

(51) Int. Cl.
*F02M 51/00* (2006.01)

(52) U.S. Cl. ..... 239/585.1; 239/585.5; 239/533.3; 239/533.14; 239/533.2

(58) Field of Classification Search ..... 239/533.3, 239/585.5, 585.1, 533.14, 533.2
See application file for complete search history.

(56) References Cited

U.S. PATENT DOCUMENTS

| | | | | | |
|---|---|---|---|---|---|
| 5,397,061 | A * | 3/1995 | Buchholz et al. | ..... | 239/408 |
| 5,544,816 | A * | 8/1996 | Nally et al. | ..... | 239/585.5 |
| 5,580,001 | A | 12/1996 | Romann et al. | | |
| 5,713,523 | A | 2/1998 | Fujikawa | | |
| 5,775,600 | A | 7/1998 | Wildeson | | |
| 5,975,436 | A * | 11/1999 | Reiter et al. | ..... | 239/585.1 |
| 5,996,910 | A * | 12/1999 | Takeda et al. | ..... | 239/585.1 |
| 6,328,232 | B1 * | 12/2001 | Haltiner et al. | ..... | 239/585.1 |
| 6,454,192 | B2 * | 9/2002 | Perry | ..... | 239/585.1 |
| 6,601,784 | B2 * | 8/2003 | Muller-Girard et al. | .. | 239/585.1 |
| 6,648,249 | B1 * | 11/2003 | Dallmeyer | ..... | 239/585.1 |
| 6,655,608 | B2 * | 12/2003 | Hornby | ..... | 239/585.1 |
| 6,769,176 | B2 * | 8/2004 | Hornby | ..... | 29/890.09 |
| 6,786,203 | B1 * | 9/2004 | Vulpillieres et al. | ..... | 123/470 |
| 6,910,642 | B2 * | 6/2005 | Maier | ..... | 239/585.1 |
| 6,948,665 | B2 * | 9/2005 | Joseph | ..... | 239/533.2 |
| 7,258,284 | B2 * | 8/2007 | Hornby | ..... | 239/533.2 |
| 2003/0201343 | A1 * | 10/2003 | Dallmeyer et al. | ..... | 239/533.2 |
| 2004/0056113 | A1 | 3/2004 | Peterson, Jr., et al. | | |
| 2004/0262430 | A1 * | 12/2004 | Joseph | ..... | 239/533.12 |
| 2005/0133630 | A1 * | 6/2005 | Hornby | ..... | 239/533.2 |

FOREIGN PATENT DOCUMENTS

| | | | |
|---|---|---|---|
| DE | 3831196 | A1 | 3/1990 |
| DE | 19730202 | A1 | 1/1999 |
| EP | 1 467 086 | A | 10/2004 |
| WO | WO 2004/033895 | A1 | 4/2004 |
| WO | WO 2005/001279 | A | 1/2005 |
| WO | WO 2005/045232 | A | 5/2005 |

* cited by examiner

*Primary Examiner*—Len Tran
*Assistant Examiner*—Trevor E McGraw

(57) ABSTRACT

A fuel injector has a housing extending along a longitudinal axis between an inlet and an outlet. The housing has an elongated member connected to a body by a thin shell connector member with a stepped portion. The connector member has a generally constant thickness with a first internal volume and a second internal volume where the second internal volume is at least 1.1 times the first internal volume.

17 Claims, 2 Drawing Sheets

FUEL INJECTOR WITH A DEEP-DRAWN THIN SHELL CONNECTOR MEMBER AND METHOD OF CONNECTING COMPONENTS

BACKGROUND OF THE INVENTION

It is believed that known fuel injectors can include a member to connect an inlet tube to a valve body. The member is believed to be formed by casting and machining a steel blank into a desired shape before the member can be assembled with the fuel injector. Because of the casting and machining of the steel blank, manufacturing of the fuel injector is believed to be inefficient due to processing time and tooling required for casting and machining.

It would be desirable to provide for a fuel injector without the potential shortcomings of the conventional fuel injector.

SUMMARY OF THE INVENTION

The present invention provides for, in one aspect, a fuel injector. The fuel injector comprises a housing and an armature disposed within the housing. The housing has a passageway extending between an inlet and an outlet along a longitudinal axis. The housing includes a tubular member, a body and a connector member. The tubular member is located proximate the inlet. The tubular member has a first tubular member end and a second tubular member end. The second end of the tubular member has an end face confronting an end face of the armature. The body is located proximate the outlet and has a first body end and a second body end. The connector member is affixed to the second tubular member end and the first body end. The connector member includes a first, intermediate and second wall portions. The first wall portion circumscribes the longitudinal axis to define a first volume. The intermediate wall portion connects the first wall portion to the second wall portion. The second wall portion circumscribes the longitudinal axis to define a second volume of at least 1.1 times the first volume.

In yet another aspect, the present invention provides for a method of connecting components of a fuel injector. The fuel injector extends along a longitudinal axis between an inlet end and an outlet end. The method comprises deep drawing a generally planar workpiece into a connector member extending along an axis so that the connector member has an outer surface surrounding an inner surface over a generally constant distance therebetween; and locating a tubular member of the fuel injector in the first portion and the second portion of the connector member in a body of the fuel injector

BRIEF DESCRIPTION OF THE DRAWINGS

The accompanying drawings, which are incorporated herein and constitute part of this specification, illustrate an embodiment of the invention, and, together with the general description given above and the detailed description given below, serve to explain the features of the invention.

DETAILED DESCRIPTION OF THE PREFERRED EMBODIMENTS

Figure 1:
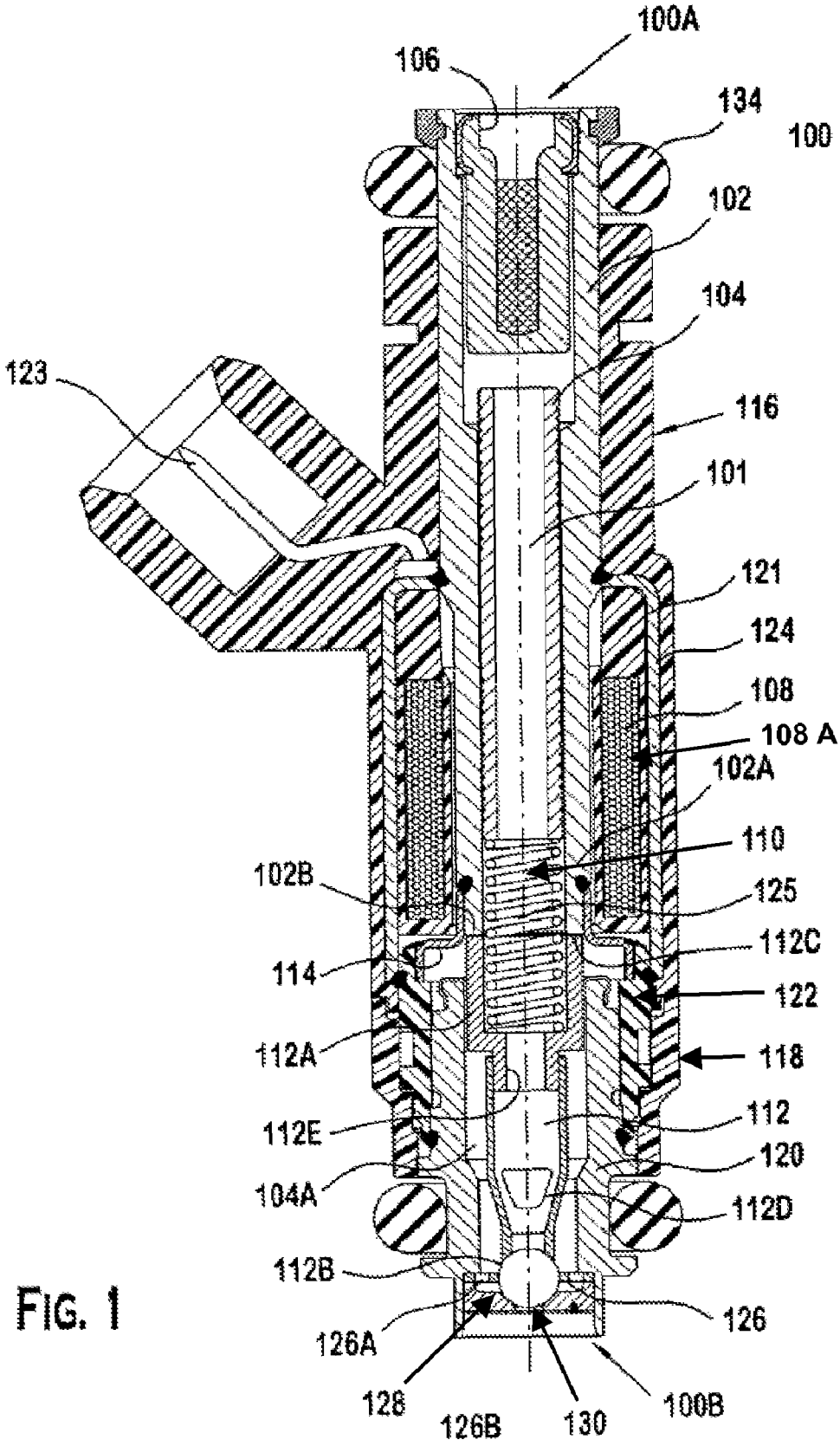
FIG. 1 is a pictorial representation of a fuel injector according a preferred embodiment.
Figure 2:
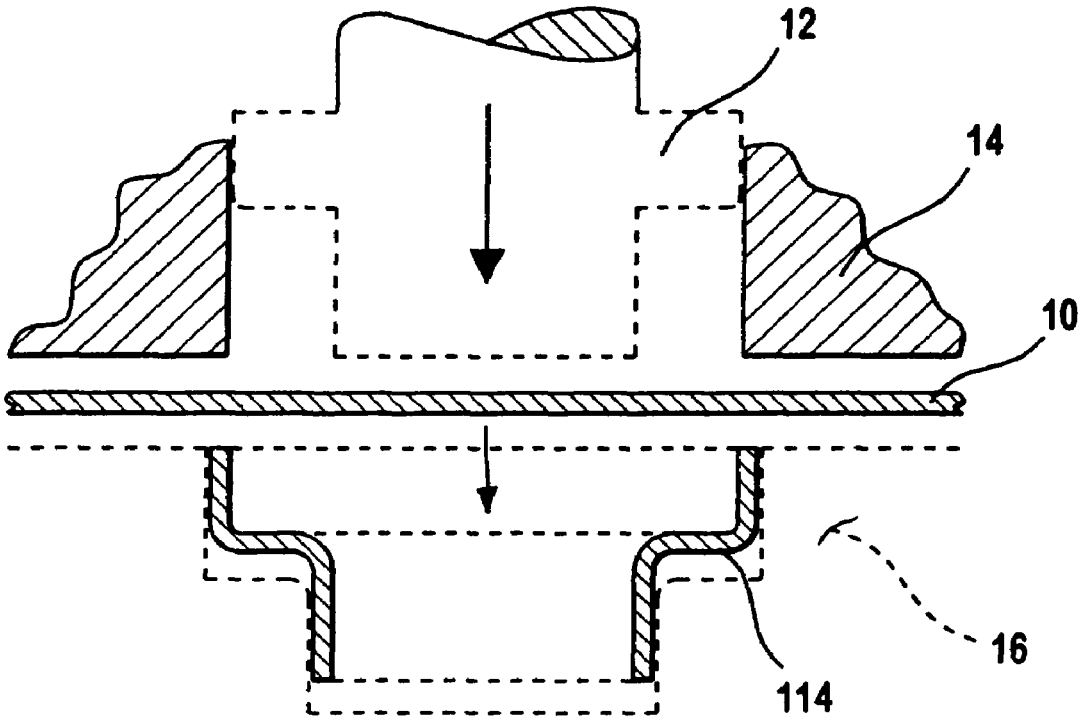
FIG. 2 is a cross sectional view of a workpiece prior to being formed into a connector shell for the fuel injector of FIG. 1.
Figure 3:
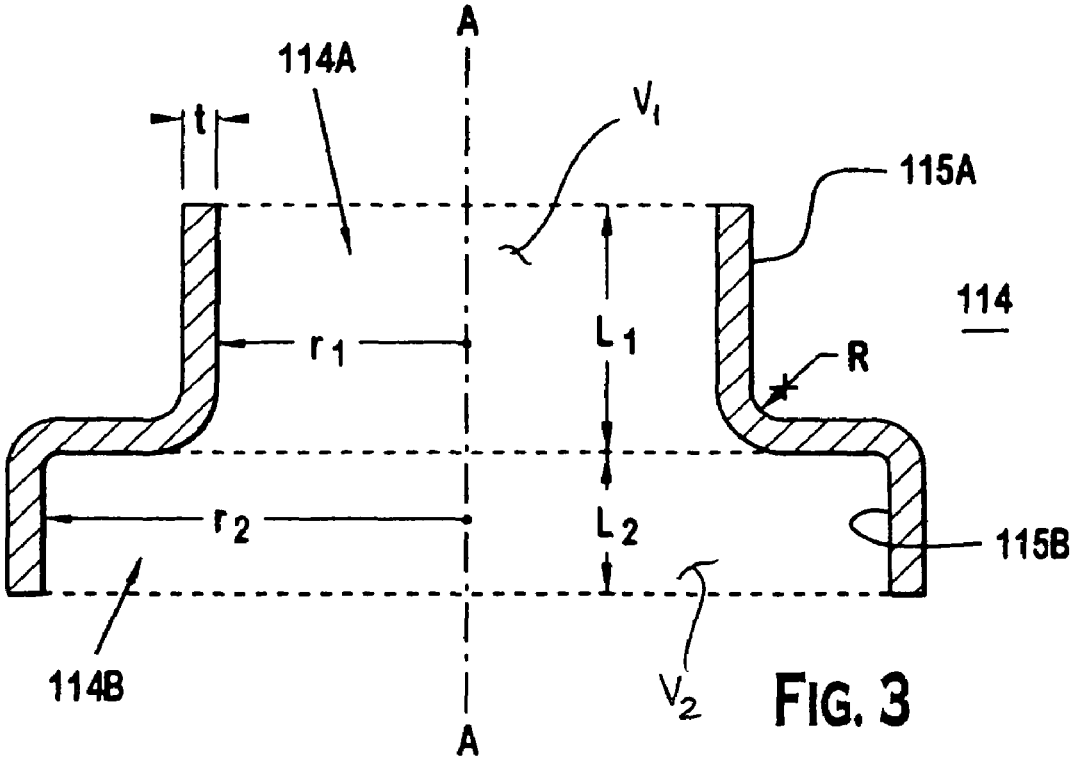
FIG. 3 is a cross-sectional view of the connector in FIG. 1.

FIGS. 1-3 illustrate the preferred embodiment. FIG. 1 shows a fuel injector 100 with an inlet end 100A and an outlet end 100B. The fuel injector 100 has a fluid passage 101 formed by tubular member 102, connector member 114, body shell 122 and body 120. The fuel injector 100 includes an adjustment tube 104, filter assembly 106, coil assembly 108 with coil 108A and bobbin 121, biasing spring 110, armature assembly 112 with an armature 112A and closure member 112B, non-magnetic connector member 114, a first overmold 116, second overmold 118, a body 120, a body shell 122, a coil assembly housing 124, a guide member 126 for the closure member 112A, a seat 128, and an orifice disk 130. The first injector end 100A can be coupled to the fuel supply of an internal combustion engine (not shown). An O-ring 134 can be used to seal the first injector end 100A to the fuel supply so that fuel from a fuel rail (not shown) is supplied to the tubular member 102, with the o-ring 134 making a fluid tight seal, at the connection between the injector 100 and the fuel rail (not shown).

Proximate the inlet end 100A, tubular member 102 can be a ferromagnetic material and includes a fuel inlet opening at the exposed upper end. Filter assembly 106 can be fitted proximate to the open upper end of adjustment tube 104 to filter any particulate material larger than a certain size from fuel entering through inlet opening 100A before the fuel enters adjustment tube 104.

Coil assembly 120 includes a plastic bobbin 121 on which an electromagnetic coil 108A is wound. Respective terminations of coil 108A connect to respective terminals 123 that are shaped and, in cooperation with a surround 118A, formed as an integral part of overmold 116, to form an electrical connector for connecting the fuel injector 100 to an electronic control circuit (not shown) that operates the fuel injector 100.

In the calibrated fuel injector 100, adjustment tube 104 can be positioned axially to an axial location within tubular member 102 that compresses preload spring 110 to a desired bias force. The bias force urges the armature/closure assembly 112 to be seated on seat 128 so as to close the central hole through the seat. Preferably, tubes 102 and 104 are crimped together to maintain their relative axial positioning after adjustment calibration has been performed.

The tubular member 102 can be formed by connecting two more elongated members together. Preferably, the tubular member 102 is a unitary elongated member with a pole piece 102A formed at an end proximate the outlet end 100B.

Proximate the outlet end 100B, the armature assembly 112 includes closure member 112A. The closure member 112A can be a suitable member that provides a seal between the member and a sealing surface of the seat 128 such as, for example, a spherical member or a needle member with a hemispherical surface. Preferably, the closure member 112A is spherical member. The closure member 112A can also be a one-piece member of the armature assembly 112. Armature assembly 112 includes a passageway 112E that communicates volume 125 with a passageway 104A in body 120, and guide member 126 contains fuel passage holes 126A. This allows fuel to flow from volume 125 through passageways 112E, apertures 112D formed on an armature tube 113 to seat 128. Armature assembly 112 can be guided by the inside wall of body 120 for axial reciprocation. Further axial guidance of the armature/closure member assembly can be provided by a central guide hole in member 126 through which closure member 112A passes.

Surface treatments can be applied to at least one of the end portions 102B and 112C to improve the armature's response, reduce wear on the impact surfaces and variations in the working air gap between the respective end portions 102B and 112C. The surface treatments can include coating, plating or case-hardening. Coatings or platings can include, but are not limited to, hard chromium plating, nickel plating or keronite coating. Case hardening on the other hand, can include, but are not limited to, nitriding, carburizing, carbo-nitriding, cyaniding, heat, flame, spark or induction hardening.

The guide member 126, the seat 128, and the orifice disk 130 form a seat assembly that is coupled at the outlet end 100B of fuel injector 100 by a suitable coupling technique, such as, for example, crimping, welding, bonding or riveting. Preferably, the seat 128 is welded to the body 120. Alternatively, a seat—as shown and described in U.S. patent application entitled "Fuel Injector With Deep Pocket Seat And Method Of Maintaining Spatial Orientation," assigned Ser. No. 10/642,629 filed on 19 Aug. 2003, which application is incorporated by reference in its entirety herein this application—can also be used instead of seat 128.

An orifice disk 130 can be used in connection with the seat 128 to provide at least one precisely sized and oriented orifice 130A in order to obtain a particular fuel spray pattern and targeting. The precisely sized and oriented orifice 130A can be disposed on the center axis of the orifice disk 130 or, preferably disposed off-axis, and oriented in any desirable angular configuration relative to one or more reference points on the fuel injector 100. It should be noted here that both the valve seat 128 and orifice disk 130 are fixedly attached to the body 120 by a suitable attachment techniques, including, for example, laser welding, crimping, and friction welding or conventional welding. The orifice disk 130 is preferably tack welded to the orifice disk retention surface 128E of the seat 128 in a fixed spatial orientation to provide the particular fuel spray pattern and targeting of the fuel spray.

According to a preferred embodiment, a magnetic flux generated by the electromagnetic coil 108A flows in a magnetic circuit that includes the pole piece 102A, the armature assembly 112, the body 120, and the coil housing 124. The magnetic flux moves across a side airgap between the homogeneous material of the magnetic portion or armature 112A and the body 120 into the armature assembly 112 and across a working air gap between end portions 102B and 112C towards the pole piece 102A, thereby lifting the closure member 112B away from the seat 128. Preferably, the width of the impact surface 102B of pole piece 102A is greater than the width of the cross-section of the impact surface 112C of magnetic portion or armature 112A. The smaller cross-sectional area allows the ferro-magnetic portion 112A of the armature assembly 112 to be lighter, and at the same time, causes the magnetic flux saturation point to be formed near the working air gap between the pole piece 102A and the ferro-magnetic portion 112A, rather than within the pole piece 102A.

Connector member 114 can be used to connect components of the fuel injector 100 together. Connector member 114 can be formed by a suitable deep drawing process. Preferably, a generally planar, non-magnetic work piece 10 can be placed on a holder 14 and deep drawn by a punch 12 through die 16, as shown schematically in FIG. 2 to form a connector member 114 with a thin shell profile. When formed by a suitable deep drawing technique the workpiece 10, connector member 114 has a continuous outer surface 115A and a continuous inner surface 115B spaced apart at a generally constant distance "t" therebetween along the longitudinal axis. Preferably, the workpiece 10 is stainless type steel with the distance "t" being about 0.4 millimeters. It should be noted any reference herein to dimensional magnitude is understood to be the dimensions of the preferred embodiment with variations due to acceptable tolerances of these dimensions that will allow the preferred embodiment to function for its intended purpose in metering fuel.

Connector member 114 has a number of features that are believed to be advantageous in providing a structural support to connect components of the fuel injector 100 together. Of particular emphasis are a first portion 114A and second portion 114B. The first portion 114A preferably has a first internal volume V1 that can be defined by first radial distance $r_1$ between the longitudinal axis A-A and the inner surface 115B as the inner surface 115B traverses along the longitudinal axis over first axial distance $L_1$. The second portion 114B preferably has a second internal volume V2 that can be defined by second radial distance $r_2$ between the longitudinal axis and the inner surface 115B as the inner surface 115B traverses along the longitudinal axis over second axial distance $L_2$.

It is believed that in order for the connector member 114 to provide sufficient structural rigidity to connect the tubular member 102 to the body shell 122, the second volume V2 can be at least 1.1 times the first volume V1. Preferably, the second volume V2 is about 1.8 times the first volume V1. In the preferred embodiment, first radial distance $r_1$ from the longitudinal axis A-A is about 2.9 millimeters; first axial distance $L_1$ is about 3.1 millimeters; second radial distance $r_2$ is about 5.0 millimeters; and second axial distance $L_2$ is about 1.7 millimeters.

In comparison with the known connector member, which has generally the same respective outside radii for the stepped portions, the first axial distance $L_1$ of the preferred embodiment of the connector member 114 is about 17% less than a similarly configured first axial distance of the known connector member, and the second axial distance $L_2$ is about 40% greater than a similarly configured second axial distance of the known connector member. By virtue of these features of the preferred embodiment of the connector member 114 when compared with the known connector member, there are believed to be at least three advantages of the preferred embodiments over the known connector member, as follows: (1) a shorter magnetic flux path (generally from the coil 108A to the valve body 120, armature 112A to the pole piece 102A back to coil 108A) is provided from the coil housing 124 through the armature 112A to the pole piece 102A due to the shorter first axial distance $L_1$, thereby allowing for a more efficient electromagnetic actuator; (2) an increased second volume V2 for a fluid chamber due to the greater second axial distance $L_2$, thereby assisting in the control of the reciprocating motion of the armature 112A; and (3) the connector member 114 can be prepared for final assembly without machining to its final dimensions of surfaces that engage other components, thereby allowing for efficient manufacturing of the fuel injector 100.

Referring to FIGS. 1 and 3, first portion 114A of connector member 114 can be telescopically fitted on and joined to the lower end of tubular member 102 with a press-fit. The second portion 114B fits inside the lower end of body shell 122 with a preferably press-fit arrangement. At least one of the tubular member 102 or the body shell 122 can be moved along the longitudinal axis A-A relative to the connector member 114 so that a working gap can be formed between the end face 102B of the pole piece and the end face 112C of the armature in a non-actuated condition of the fuel injector, i.e., where the closure member 112B is biased against the seat 128 to prevent flow. Alternatively, one of the tubular member 102 or body shell 122 can be affixed by a continuous weld formed proximate the circumference of the connector member 114 while the other of the tubular member 102 or body shell 122 can be moved along the longitudinal axis to achieve a desired working gap. In yet another variation, the tubular member 102 and body shell 122 can be affixed to the connector 114 while the body 120 can be adjusted along the longitudinal axis A-A to provide for the desired working gap. After the desired working gap is formed between the pole piece and armature, at least one of the tubular member 102 or the body shell 122 can be affixed by a continuous weld formed proximate the circumference of the connector member 114.

Thereafter, the coil housing 124 can be affixed to the body shell 122 with preferably a continuous weld formed on one of a circumference of the body shell 122 and an inner surface of the coil housing 124. The partially assembled fuel injector can be placed into a mold and at least one overmold can be formed to surround the tubular member 102 and at least a portion of the body 120. Preferably, a first overmold 116 surrounds a portion of the tubular member 102 and coil housing 124 and a second overmold 118 surrounds a portion of the body shell 122 and body 120 to provide an operational fuel injector.

In operation, the electromagnetic coil 108A is energized, thereby generating magnetic flux in the magnetic circuit. The magnetic flux moves armature assembly 112 (along the axis A-A, according to a preferred embodiment) towards the integral pole piece 102A, i.e., closing the working air gap. This movement of the armature assembly 112 separates the closure member 112B from the seat 128 and allows fuel to flow from the fuel rail (not shown), through the tubular member 102, passageways 101 and 104A, the through-bore 112D, between the seat 128 and the closure member 112B, through the seat opening, and finally through the orifice disk 130 into the internal combustion engine (not shown). When the electromagnetic coil 108A is de-energized, the armature assembly 112 is moved by the bias of the resilient member 226 to contiguously engage the closure member 112B with the seat 128, and thereby preventing fuel flow through the injector 100.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What I claim is:

1. A fuel injector comprising:

a housing having a passageway extending between an inlet and an outlet along a longitudinal axis, and an armature disposed within the housing, the housing including:

a tubular member proximate the inlet, the tubular member having a first tubular member end and a second tubular member end, the second end of the tubular member having an end face confronting an end face of the armature, a portion of the armature coated with one of a hard chromium plating, nickel plating or keronite coating;

a body proximate the outlet, the body having a first body end and a second body end;

a generally spherical closure member directly coupled to a hollow armature tube of the armature, the armature comprising the hollow armature tube and a distinct magnetic portion separate from and coupled to the hollow armature tube, the magnetic portion adapted to contact and constrain a biasing spring that is adapted to urge the generally spherical closure member to close a seat orifice of a seat, an aperture formed on the hollow armature tube adapted, to allow fuel to flow to the generally spherical closure member; and a connector member affixed to the second tubular member end and the first body end, the connector member including a first wall portion circumscribing the longitudinal axis to define a first volume, an intermediate wall portion connecting the first wall portion to a second wall portion, the second wall portion circumscribing the longitudinal axis to define a second volume of at least 1.1 times the first volume, the connector member connected to the tubular member and to the body via a press-fit arrangement;

wherein the first wall portion, the intermediate wall portion and the second wall portion each have substantially the same thickness and are formed by a deep drawing process wherein the second volume comprises a volume of about 1.8 times the first volume such that an increased second volume assists in controlling reciprocating motion of said armature; and wherein the first wall portion comprises a first inner wall surface extending about 3.1 millimeters along the longitudinal axis such that an electromagnetic force increases as a result of a shortened magnetic flux path.

2. The fuel injector of claim 1, wherein the first wall portion comprises a first outer wall surface generally parallel to the first inner wall surface over a distance of about 0.4 millimeters.

3. The fuel injector of claim 2, wherein the second wall portion comprises a second inner wall surface extending about 1.7 millimeters along the longitudinal axis and spaced about 5 millimeters therefrom.

4. The fuel injector of claim 3, wherein the second wall portion comprises a second outer wall surface generally parallel to the second inner wall surface over a distance of about 0.4 millimeters.

5. The fuel injector of claim 4, wherein the intermediate wall portion extends generally transverse to and about the longitudinal axis from a distance of about 3.1 millimeters from the longitudinal axis to a radial distance of about 5 millimeters from the longitudinal axis.

6. The fuel injector of claim 5, wherein the end face of the tubular member comprises a pole piece, and wherein the tubular member and the pole piece comprise a unitary one-piece member, a width of an impact surface of the pole piece greater than a width of a cross-section of an impact surface of a magnetic portion of the armature, a smaller cross-sectional area of the magnetic portion of the armature adapted to cause a magnetic flux saturation point to be formed near a working air gap between a pole piece and the magnetic portion of the armature, rather than within the, pole piece.

7. The fuel injector of claim 5, wherein a first outer surface of the connector member surrounds an outer portion of the second end of the tubular member, the first outer surface being affixed to the outer portion by a continuous weld.

8. The fuel injector of claim 7, wherein the first body end comprises an outer body surrounding a second outer surface of the second wall portion, the outer body being affixed to the second outer surface by a continuous weld formed therebetween.

9. The fuel injector of claim 8, wherein the second body end comprises an inner body, the inner body being surrounded by a portion of the outer body and affixed thereto by a continuous weld formed therebetween.

10. The fuel injector of claim 9, further comprising:

the seat disposed within the body, the seat having a seating surface contiguous to the closure member in one position of the armature occluding flow through the seat orifice and spaced therefrom in another position of the armature to permit flow through the seat orifice;

a filter being disposed proximate the first end of the tubular member; a resilient member having one portion disposed proximate the second end of the tubular member and another portion disposed within a pocket of the armature; an adjusting tube being located within the tubular member, the adjusting tube engaging the one portion of the resilient member so as to bias the closure member towards the one position.

11. The fuel injector of claim 10, wherein the inner body comprises a seat pocket receiving the seat, the seat being affixed to the seat pocket with a continuous weld.

12. The fuel injector of claim 11, wherein the seat further comprises an orifice disk tack welded to a second surface of the seat, the orifice disk having a plurality of through openings being disposed about the longitudinal axis and in fluid communication with the seat orifice.

13. The fuel injector of claim 12, wherein the armature comprises an elongated body extending along the longitudinal axis between first and second armature ends, the armature including a passageway extending from the first armature end to the second armature end.

14. The fuel injector of claim 13, wherein, the armature tube has a first tube end telescoping into the second armature end by a press-fit and a second tube end affixed to the closure member by a continuous weld disposed on a circumference of the second tube end.

15. A method of connecting components of a fuel injector extending along a longitudinal axis between an inlet and outlet, the method comprising:

deep drawing a generally planar work piece into a connector member extending along an axis so that the connector member has an outer surface surrounding an inner surface over a generally constant distance therebetween; and affixing a tubular member of the fuel injector to a first portion of the connector member via a press-fit arrangement; and affixing a second portion of the connector member to a body of the fuel injector via a press-fit arrangement, the injector comprising a generally spherical closure member directly coupled to a hollow armature tube of an armature, the armature comprising the hollow armature tube and a distinct magnetic portion separate from and coupled to the hollow armature tube, the magnetic portion adapted to contact and constrain a biasing spring that is adapted to urge the generally spherical closure member to close a seat orifice of a seat, an aperture formed on the hollow armature tube adapted to allow fuel to flow to the generally spherical closure member, a portion of the armature hardened via one of nitriding, carburizing, carbonitriding, cyaniding, heat flame, spark or induction hardening, wherein at least a portion of a coil surrounds at least a portion of the outer surface of the connector member;

wherein the deep drawing comprises forming said first portion defining a first volume about the axis and said second portion defining a second volume about the axis greater than the first volume.

16. The method of claim 15 wherein the method further comprises moving at least one of the tubular member and the body along the longitudinal axis relative to the connector member so that a gap is formed between an end face of the tubular member and an armature end face when the fuel injector is in a non-actuated condition.

17. The method of claim 16, wherein the method further comprises welding respective portions to the tubular member and the body with a continuous circumferential weld.

* * * * *